United States Patent [19]

Haney et al.

[11] Patent Number: 4,911,240

[45] Date of Patent: Mar. 27, 1990

[54] SELF TREATING PARAFFIN REMOVING APPARATUS AND METHOD

[76] Inventors: Robert C. Haney, P.O. Box 117, San Marcos, Tex. 78666; Bobby F. Golden, Beaver Creek, #14, Caldwell, Tex. 77836; Bernard L. Watkins, P.O. Box 2839, Bryan, Tex. 77805-2839

[21] Appl. No.: 356,577

[22] Filed: May 22, 1989

Related U.S. Application Data

[63] Continuation of Ser. No. 138,067, Dec. 28, 1987, abandoned.

[51] Int. Cl.[4] ..... F21B 37/06

[52] U.S. Cl. ..... 166/304; 166/267; 210/774

[58] Field of Search ..... 166/303, 304, 305.1, 166/312, 57, 902, 267; 210/774, 187, 180

[56] References Cited

U.S. PATENT DOCUMENTS

| | | | |
|---|---|---|---|
| 2,300,348 | 10/1942 | Dana | 166/304 X |
| 2,825,422 | 3/1958 | Schoenfeld | 210/187 X |
| 2,837,213 | 6/1958 | Murdock, Sr. | 210/187 |
| 3,593,790 | 7/1971 | Herce | 166/267 |
| 3,705,626 | 12/1972 | Glenn, Jr. et al. | 166/267 |
| 3,908,763 | 9/1975 | Chapman | 166/304 X |
| 4,407,367 | 10/1983 | Kydd | 166/304 X |
| 4,465,138 | 8/1984 | Hunt, III | 166/303 |
| 4,609,041 | 9/1986 | Magda | 166/62 |
| 4,813,482 | 3/1989 | Walton | 166/267 |

*Primary Examiner*—William P. Neuder

*Attorney, Agent, or Firm*—J. Nevin Shaffer, Jr.

[57] ABSTRACT

A self treating paraffin removing mechanism utilizing existing above ground equipment. The above ground equipment utilized is a heater treater normally employed at the typical well for separating oil from water and wastes. As desired, the operator, utilizing this invention, can direct heated oil from the heater treater to the well head annulus and then down hole and back up through the well string so that paraffin and other wastes are removed from the interior of the well piping. The oil and waste are then passed to the heater treater in the normal manner and the operation can be repeated as often as necessary or as desired. As a result, no costly insulation of the entire well string nor costly utilization of heater oil trucks is needed and an inexpensive flexible alternative is provided.

9 Claims, 1 Drawing Sheet

SELF TREATING PARAFFIN REMOVING APPARATUS AND METHOD

BACKGROUND OF THE INVENTION

This application is a continuation of application Ser. No. 07/138,067 filed Dec. 28, 1987 now abandoned.

This invention relates to an improved self treating paraffin removing mechanism for removing paraffin from an operating oil well system.

As is known in the art, as oil is pumped from the ground, it is cooled by passage through intermittent water layers and paraffin deposits build up on the inside of the well piping. There exist two standard means of combating this problem of paraffin buildup. One method is to install insulation surrounding the piping so that the temperature drop is not transmitted to the hot oil, thereby preventing the paraffin from depositing itself on the well piping.

A second method, and the one most commonly utilized in existing wells, is known as outside hot batch treatment or "hot oiling a well". Typically, a well owner hires a hot oiler after waiting until the well string is almost plugged, because the treatment is expensive. It involves the utilization, typically, of a butane truck to heat the oil which is then forced by pump pressure down the well string. A typical "treatment" involves the use of 300 gallons of heated oil and, as an additional cost, the rental of the heating truck at approximately $100/hour for three hours or more. This system is exemplified in Hunt, III, U.S. Pat. No. 4,465,138 and Magda U.S. Pat. No. 4,609,041. Hunt requires the well to be shut in to "allow the formation to undergo a soaking period". No mention in Hunt is made of the utilization of existing heater treater equipment located at the typical well. Magda clearly illustrates the hot oil technique discussed above and envisions a movable "hot oil apparatus 46" which can be moved to various wells as needed.

Both the insulating and hot oiling techniques, commonly in use today, are costly and time consuming. Thus, there is a need in the art for providing a self treating paraffin removing apparatus and method which is inexpensive, which utilizes existing equipment available at every oil well and which may be selectively utilized by a well operator on a frequent basis so that the production string is kept continuously free of paraffin and other solids which settle out of the oil and attach themselves to the interior of the piping. It, therefore, is an object of this invention to provide a unique self treating paraffin removing mechanism for inexpensively and efficiently removing paraffin from the interior of a well string.

SHORT STATEMENT OF THE INVENTION

Accordingly, the self treating paraffin removing mechanism of the present invention includes a fixed heater treater for heating and separating oil, water and wastes, such as wax. Further, the heater treater is connected by means of insulated piping to the well head annulus so that heated oil can be selectively directed to the well head annulus and from there to the bottom of a well string. From the well head annulus, a connection is made to an inlet connection on the heater treater so that the heated oil introduced into the well string, which passes through the well string, dissolving paraffin as it passes, is returned to the heater treater where oil, water and wax are once again separated.

Further, the heater treater is connected to oil and waste-water storage tanks and valves are introduced that enable the well operator to selectively direct the heated oil to either the storage tank or to the well head annulus.

As a result, because heated oil taken directly from the heater treater is utilized, no additional oil or expensive apparatus or separate trucks and heaters are required on a costly and repetitive basis. Instead, the user of the present invention can selectively introduce heated oil on a regular and frequent basis to keep the well operating free from paraffin and other material which may build up on the interior of the well string as the oil cools upon rising to the surface. That is, this system may be used as often as needed by the operator at little or no additional cost or loss of time waiting for a hot oiler to arrive nor is any additional oil lost, as is the case in oil used in the truck treating process.

BRIEF DESCRIPTION OF THE DRAWINGS

Other objects, features and advantages of the present invention will become more fully apparent from the following detailed description of the preferred embodiment, the appended claims an accompanying drawing in which:

DETAILED DESCRIPTION OF THE PREFERRED EMBODIMENT

Figure 1:
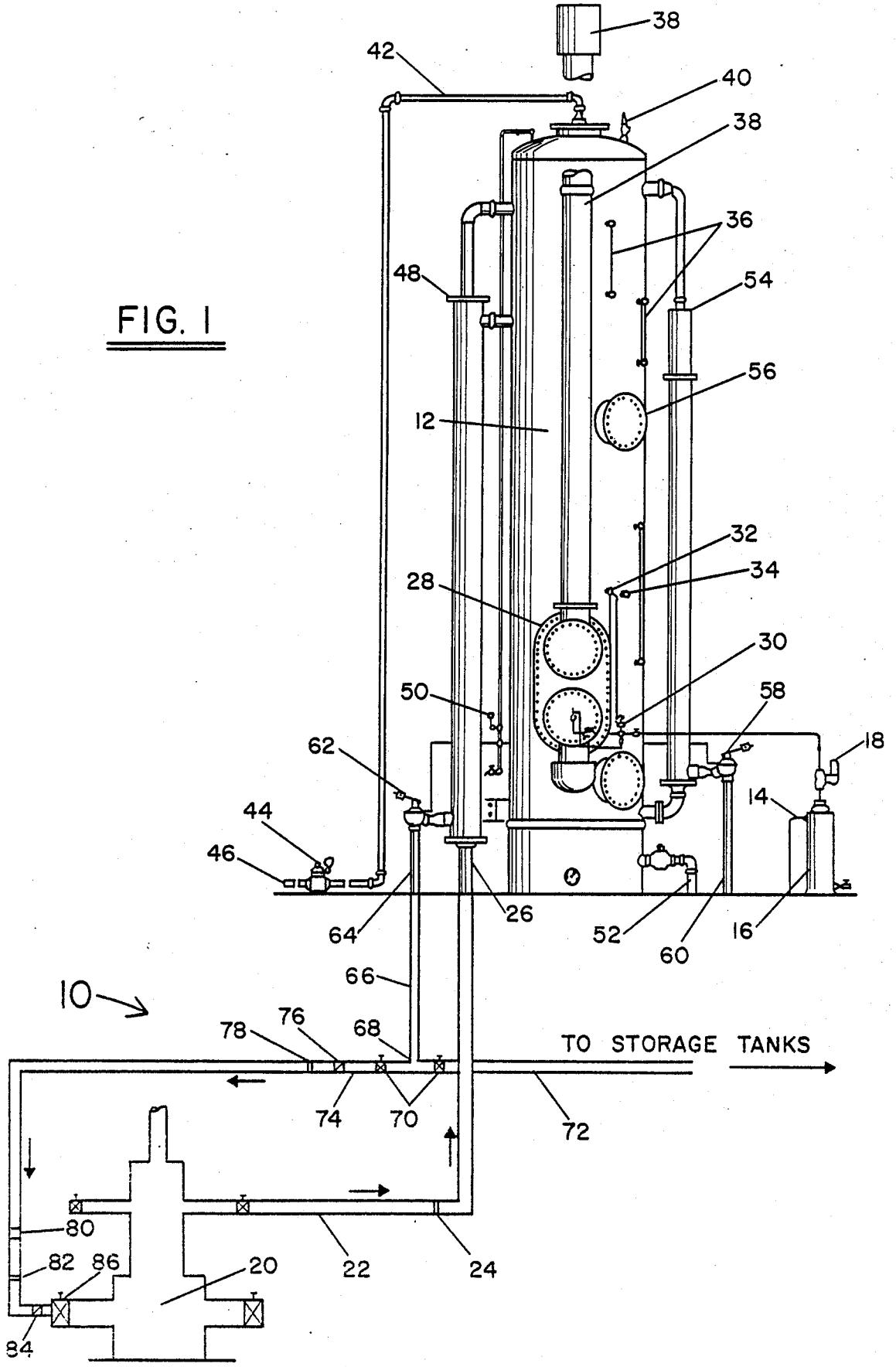
FIG. 1 is a side view of a preferred embodiment of a self treating paraffin removing mechanism of the present invention showing a heater treater unit and the connection of it to the well head.

The preferred embodiment of the present invention is illustrated by way of example in FIG. 1. With specific reference to FIG. 1, a self treating paraffin removing mechanism 10 includes a standard heater treater 12, known in the art. Heater treater 12 is connected to fuel gas supply 14, fuel gas scrubber 16, and fuel gas regulator 18. As the oil and waste/water containing contaminants such as paraffin are removed from the well at well head 20, it is passed to flow line 22, past thermometer 24 into heater treater inlet 26.

Heater treater 12 contains fire box 28, fuel gas manifold 30, thermostat 32, and thermometer 34. FIG. 1 also shows gauge glasses 36, exhaust stack 38 and safety valve 40. Also shown is gas outlet line 42, gas back pressure valve 44 and gas outlet 46.

Also shown are heat exchanger manifold 48, gas equalizer manifold 50 and drain 52. Also shown is adjustable water syphon 54, 16" manway 56, water dump valve 58 and water outlet 60.

FIG. 1 shows oil dump valve 62 and oil outlet 64. Oil outlet 64 is connected to insulated connecting pipe 66 with a "T" connection 68. "T" connection 68 has two gate valves 70 on either side of the "T". On one side of the gate valve 70, connecting pipe 72 goes to an oil storage tank (not shown). On the other side of the other gate valve 70, insulated connecting pipe 74 passes through check valve 76, thermometer 78, full close high pressure valve 80, thermometer 82, check valve 84 and gate valve 86 in well head 20.

In operation, heater treater 12 operates in a manner known in the art to separate oil, water and wastes, such as paraffins, from oil that is produced. The oil from the well head 20 passes through flow line 22 to inlet 26 of heater treater 12. In the normal operation of a typical well, the oil, water, waste mixture is heated by means of gas, or otherwise, forcing a separation of the mixture into oil, gas, and waste/water. Waste is passed to water outlet 60 and from there it is passed through connection lines, not shown, to a storage tank for further disposal. Gas that may be produced is passed to gas outlet 46 and from there through a connecting line to a storage tank, not shown, where it is disposed of as desired. In normal operation, heated oil would pass through oil outlet 64 to insulated connection pipe 66 to "T" 68. Gas valve 70 connected to insulated connecting pipe 74 would be closed and gate valve 70 connected to connecting pipe 72 would be open so that the heated oil passes to a storage tank, not shown, for collection and further disposition as desired.

In the present invention, gate valve 70, connected to connecting pipe 72, is closed, gate valve 70, connected to insulated connecting pipe 74, is opened and heated oil, heated in the ordinary course of business, is passed to well head 20 through gate valve 86. From there, the heated oil is introduced into the well string where it dissolves paraffin and other wastes that are deposited on the interior of the well string. This heated oil dissolves paraffin and other wastes and then exits well head 20 and passes into flow line 22 and thence back to heater treater 12 through inlet 26. This process may then be repeated as often as necessary.

As a result, by using the self treating paraffin removing mechanism of the present invention, the oil operator can keep his production string free of paraffin and any other undesirable substances, thus allowing the free flow of oil from the formation. The mechanism of the present invention may be used as often as needed by the operator at little or no additional cost or loss of time to the normal operation of a hydrocarbon well. The mechanism of the present invention replaces the more costly and time consuming methods commonly used today. It is more effective and less costly than using trucks to pump hot oil, liquid and/or chemicals down the hole where it is typically immediately pumped back up through the production string so that the liquid or chemical does not have a chance to work properly. That is to say, unless the well is shut down, a costly procedure, those systems using chemicals to remove built up waste typically are not as effective as they are alleged to be. The present invention enables the operator to utilize the waste removing attributes available at the well as early and often as necessary at minimal additional expense.

While the present invention has been disclosed in connection with the preferred embodiment thereof, it should be understood that there may be other embodiments which fall within the spirit and scope of the invention as defined by the following claims.

What is claimed is:

1. A self treating paraffin removing apparatus for oil wells adapted to produce through a string of production tubing hung within the well bore to form a well annulus, said apparatus comprising:

A. a heater treater means for heating and separating oil, water and waste;

B. first connecting means attached to said heater treater means and to a well head annulus connection, the first connecting means being adapted for selectively directing heated oil in a substantially liquid phase from said heater treater to said well head annulus connection and from there through the well annulus to the bottom of the well in position to be produced through the production tubing; and C. second connecting means attached to an inlet connection on said heater treater means and to a well head production connection, the second connecting means being adapted for directing produced fluids including said heated oil and wastes, such as paraffin, dislodged from the production tubing to said heater treater means where said oil, water and waste are separated.

2. The apparatus of claim 1 wherein said first connecting means attached to said heater treater means further comprises storage tank connection means connected to an oil storage tank for selectively directing heated oil from said heater treater means to said oil storage tank.

3. A self treating paraffin removing mechanism comprising:

A. a fixed heater treater means for heating and separating oil, water and waste;

B. first connecting means attached to said fixed heater treater means and to a well head annulus connection of a hydrocarbon producing well, said first connecting means being adapted for directing heated oil in a substantially liquid phase from said fixed heater treater means to said well head annulus connection and from there to the bottom of the hydrocarbon well through a well annulus;

C. second connecting means attached to an inlet connection on said fixed heater treater means and to a well head production connection of said hydrocarbon producing well, the second connecting means being adapted for directing produced fluids including said heated oil and dislodged wastes, such as paraffin, to said fixed heater treater means where said oil, water and waste are separated; and D. separate, third connection means attached to an oil storage tank for selectively directing said heated oil from the fixed heater treater means to said oil storage tank.

4. A self treating paraffin removing method for oil wells comprising the steps of:

A. providing a heater treater means for heating and separating oil and water and wastes;

B. attaching a first connecting means to said heater treater means and to a well head annulus connection of an oil well so that heated oil from said heater treater means is directed to said well head annulus connection and from there to the bottom of the hydrocarbon well; and C. providing a second, outlet connection means connected an inlet connection to said heater treater means so that said heated oil, introduced to said bottom of said well, passes through well piping to said outlet, dissolving wastes, such as paraffin, as it passes and is returned to said inlet connection on said heater treater means where said oil, water and waste are separated.

5. The method of claim 4 further comprising the step of providing separate third and fourth connection means attached to oil and waste/water storage tanks and providing valve means for selectively directing said heated oil to said oil storage tank and to said well head annulus.

6. A self treating paraffin removing method for oil wells comprising the steps of:

A. providing a fixed heater treater means for heating and separating oil, water and wastes;

B. attaching a first connecting means to said fixed heater treater means and to a well head annulus connection so that heated oil is directed to said well head annulus connection and from there to the bottom of a hydrocarbon well;

C. attaching a second connecting means to an inlet connection on said fixed heater treater means so that said heated oil passes through well piping, dislodging wastes, such as paraffin, as it passes, and is returned to said fixed heater treater means where said oil, water and waste are separated; and D. providing separate, third and fourth, connection means attached to oil and waste/water storage tanks and providing valve means for selectively directing said heated oil to said oil storage tanks and to said well head annulus.

7. A self treating paraffin removing method for an oil and gas producing well comprising the steps of:

A. directing produced fluid from the well production tubing to a heater treater;

B. heating the produced fluid in the heater treater for separating liquid hydrocarbons from produced water;

C. periodically directing heated liquid from the heater treater to the well through a well head annulus connection, the heated liquid dissolving or melting paraffin which may have collected in the tubing; and D. pumping the well to produce reservoir fluid, the dissolved or melted paraffin, and the liquid previously heated in the heater treater through the production tubing.

8. The method of claim 7 wherein the steps of pumping the well and directing the heated liquid to the well are performed simultaneously.

9. The method of claim 7 wherein the step of directing heated liquid from the heater treater to the well comprises directing heated oil from a heater treater oil outlet to the well.

* * * * *